US006596975B1

(12) United States Patent
Vinden et al.

(10) Patent No.: US 6,596,975 B1
(45) Date of Patent: Jul. 22, 2003

(54) METHOD FOR INCREASING THE PERMEABILITY OF WOOD

(75) Inventors: Peter Vinden, Creswick (AU); Francisco Javier Romero, Maroochydore (AU); Grigory Torgovnikov, Creswick (AU)

(73) Assignee: The University of Melbourne, Parkville (AU)

( * ) Notice: Subject to any disclaimer, the term of this patent is extended or adjusted under 35 U.S.C. 154(b) by 0 days.

(21) Appl. No.: 09/719,294

(22) PCT Filed: Jun. 9, 1999

(86) PCT No.: PCT/AU99/00443

§ 371 (c)(1),
(2), (4) Date: Feb. 12, 2001

(87) PCT Pub. No.: WO99/64213

PCT Pub. Date: Dec. 16, 1999

(30) Foreign Application Priority Data

Jun. 9, 1998 (AU) ..... PP3969

(51) Int. Cl.[7] ..... H05B 6/64; B27K 5/06

(52) U.S. Cl. ..... 219/678; 219/679; 219/700; 34/259; 144/380

(58) Field of Search ..... 219/678, 679, 219/702, 700; 34/259, 263, 264, 265, 255, 256, 245; 144/380

(56) References Cited

U.S. PATENT DOCUMENTS 4,469,156 A * 9/1984 Norimoto et al. ..... 144/380
5,075,131 A 12/1991 Hattori et al.
5,555,642 A * 9/1996 Rem et al. ..... 34/246
6,105,278 A * 8/2000 Gerrish et al. ..... 219/697

FOREIGN PATENT DOCUMENTS

DE 3707042 10/1987

OTHER PUBLICATIONS

Derwent WPAT on line Abstract Accession No. 84–027441, JP 58–219005, A, Dec. 20, 1983.

Patent Abstract of Japan, JP, 10–071608, A, Mar. 17, 1998.

* cited by examiner

*Primary Examiner*—Philip H. Leung
(74) *Attorney, Agent, or Firm*—Dorsey & Whitney LLP; David J. Brezner

(57) ABSTRACT

A method for increasing the permeability of wood which comprises subjecting wood with a moisture content (based on dry weight) of at least 15% to microwave radiation at a frequency (f) in the range of from about 0.1 to about 24 GHz with a power intensity (p) from about 10 W/cm$^2$ to about 100 kW/cm$^2$ for a duration of from about 0.05 to about 600 seconds to cause water in the wood to vaporise resulting in an internal pressure in the wood such that the permeability of the wood is increased by partial or complete destruction of ray cell tissue, softening and displacement of wood resin, formation of pathways in the radial direction of the wood and/or by creating, on the base of destroyed rays, cavities in the wood, said cavities being primarily in radial-longitudinal planes of the wood, and wherein the overall integrity of the wood is substantially maintained. A wood-based material may be formed having a permeability which is at least 5 times that of the untreated wood.

11 Claims, 5 Drawing Sheets checks 32

METHOD FOR INCREASING THE PERMEABILITY OF WOOD

The present invention relates to the treatment of wood, and is particularly concerned with a method for increasing the permeability of wood, especially moist wood.

The treatment of wood by impregnating it with preservatives and other agents, such as for fire-proofing, is very well known. One of the problems of the impregnation treatment is ensuring that the agent has impregnated the wood fully or at least sufficiently.

It is also known to prepare wood for impregnation by using steam to raise the temperature and pressure in the wood and break down some of the wood cells (after the pressure is rapidly reduced) and thereby to improve the natural permeability of the wood. Updated steaming specifications for, for example, round wood radiata pine steam conditioning recommend the use of steam at a temperature of 127° C. and pressure of 138 kPa for a period of from 1.5 to 18 hours depending upon the thickness of the wood before the pressure is rapidly reduced. While this treatment does help to improve the impregnation process, it has several disadvantages, particularly the duration of the treatment and the requirement for high pressure steam.

It is also known to dry wood and to form fibres by destroying the wood structure using microwave energy. It is important in drying the wood using microwave energy not to damage the wood and special drying schedules have been proposed for different wood species. In all of these schedules the microwave radiation intensity is very low, below 5 to 10 $W/cm^2$, in order to avoid damage to the wood.

Destruction of wood using microwave energy to form fibres is performed at a considerably higher radiation intensity, for example up to 150 $kW/cm^2$, with the aim of heating the moisture in the wood to form steam very quickly and in sufficient quantity to entirely break down the structure of the wood.

According to one aspect of the present invention there is provided a method for increasing the permeability of wood which comprises subjecting wood with a moisture content (based on dry weight) of at least 15% to microwave radiation at a frequency (f) in the range of from about 0.1 to about 24 GHz with a power intensity (p) from about 10 $W/cm^2$ to about 100 $kW/cm^2$ for a duration of from about 0.05 to about 600 seconds to cause water in the wood to vaporise resulting in an internal pressure in the wood such that the permeability of the wood is increased by partial or complete destruction of ray cell tissue, softening and displacement of wood resin, formation of pathways in the radial direction of the wood and/or by creating, on the base of destroyed rays, cavities in the wood, said cavities being primarily in radial-longitudinal planes of the wood, and wherein the overall integrity of the wood is substantially maintained.

There is also provided wood whenever treated by the method described in the immediately preceding paragraph.

Using the method of the invention, it is possible to selectively or randomly treat wood and produce wood having regions of differing permeability. Therefore, according to another aspect of the invention there is provided wood having regions of differing permeability, wherein at least one of said regions has been treated to increase the permeability thereof relative to the untreated wood.

The microwave treatment of the present invention increases the permeability of the wood typically by vaporising water contained in the wood to create an internal pressure and a temperature above 100° C. resulting in the modification of the wood structure by any one or more of the destruction of ray cells in the wood, softening and mobilising of the resin in the wood and replacing it at least partially with open pores, and the creation of thin radial checks, resulting in cavities disposed mainly in radial-longitudinal planes. There may be no substantial drying of the wood during the process of the invention. The present invention may facilitate in-line processing of wood such as for impregnation or fast drying. That is, the thin, radial checks and cavities formed by the method of the present invention may allow more effective impregnation of certain treatment agents. The thin radial checks or cavities may also allow faster subsequent drying treatments than compared with the drying techniques conventionally employed in the absence of the treatment of the present invention. For example, hard wood species (i.e. refractory woods), such as eucalypts, may experience internal checking and collapse upon fast drying without the prior treatment of the present invention due to excessive pressure build up within the wood.

The microwave treatment of the present invention is not necessarily limited to subjecting the wood to a single microwave frequency or power intensity. The method may comprise, for example, subjecting the wood to various microwave frequencies and power intensities in a single treatment. Preferably, the power intensity, whether a single power intensity or a number of different power intensities are used, is maintained at not less than 10 $W/cm^2$. In a preferred embodiment, however, the power intensity is maintained above 10 $W/cm^2$.

The microwave treatment of the present invention may also be used to increase the permeability of a portion or portions of the wood either selectively or randomly. For example, energy impulses of predetermined duration and separated by set time intervals or random impulses may be used to treat the wood. Alternatively, microwaves may be directed at a portion or portions of wood to be treated. If a plurality of portions are to be treated, these may be selected randomly or in a predetermined manner with the proposed use of the final product in mind. That is, depending on the required flexibility, strength, permeability and other required characteristics of the product. Wood produced by either this selective or random treatment comprises regions of differing permeability wherein a treated portion of the wood constitutes at least one region and an untreated portion constitutes another region, and wherein the treated portion has greater permeability than the untreated portion.

The process of the present invention is preferably applied to the treatment of moist wood. As used herein and throughout the specification the term "moist wood" refers broadly to wood which is "green" after sawing as would be understood by a person skilled in the art. The amount of water present in the moist wood will, of course, vary depending on the species of plant, but it is considered that moist wood will generally have a moisture content in the range of from about 30 to about 200% based on the dry weight of the wood. The process of the present invention is also applicable to the treatment of wood having lower moisture contents, such as from 15% to 30%.

Wood is capable of absorbing very high quantities of microwave energy. The microwave energy causes the water in the cells of the wood to heat up and boil, creating steam pressure in the cells which results in the destruction of cell walls. The ray cells have thinner walls than the cells of the main wood tissues (tracheids, libriform) and ray cells are destroyed by the microwave energy before cells of the main wood tissue. The destroyed ray cells form paths in the radial direction for the easy transportation of liquids and vapours inwardly from the outer surface. Ray cells form from about 5 to about 35% of the wood volume, so their destruction may increase the wood permeability substantially.

The treatment, therefore, advantageously results in the destruction of ray cells while substantially maintaining the overall integrity of the wood. That is, the destruction of the ray cells may occur without significant destruction of cells of the main wood tissues (commonly referred to as the grains or fibres of the wood) resulting in treated wood which, as discussed hereafter, will generally have decreased tortional strength, but substantially unaffected flexural strength in the radial direction. In a treatment of approximately four seconds duration, for example, a low frequency (f) of about 0.4 GHz is preferably used with a power intensity (p) of about 6 kW/cm$^2$. A higher frequency of, for example 10 GHz is preferably used with a lower power intensity of about 0.24 kW/cm$^2$. Most preferably, a frequency of from about 1 to about 2.4 GHz is used with a power intensity of from about 2.4 kW/cm$^2$ to about 1 kW/cm$^2$.

As discussed above, increasing the intensity of microwave energy supplied to the wood increases the steam pressure therein to the extent of ray volume that the tracheid (libriform) walls begin to rupture. The tensile strength of wood is two to three times less in the tangential direction than in the radial direction and with increased internal pressure, for example corresponding to increased intensity of microwave energy, the wood may be destroyed along the main wood tissues. This results in checks which extend in the radial-longitudinal planes. Furthermore, as the tensile strength of the wood in the tangential direction reduces, as the temperature (and pressure) increases, the checks may be formed in the wood at comparatively low pressures. The treated wood will, therefore, generally have decreased torsional strength, but substantially unaffected flexural strength in the radial direction.

When subjected to microwave energy, any resin in the wood softens before melting and boiling. Steam pressure in the wood forces the soft resin to be displaced from rays, leaving pores or cavities in the wood. This is a particularly effective means of increasing the permeability of wood having substantial quantities of resin.

For the softening of resin and its removal from, for example, radiata pine in a treatment of about 12 seconds duration, a frequency of about 0.4 GHz and power intensity of about 2 kW/cm$^2$ are preferably used. If a higher frequency of about 10 GHz is used, the power intensity is preferably about 0.08 kW/cm$^2$. More preferably a frequency of from about 1 to about 6 GHz is used with a power intensity of from about 0.08 to about 0.13 kW/cm$^2$.

The present invention substantially maintains the integrity or overall structure of the wood, but provides increased permeability which may enhance impregnation during subsequent treatments. The range of microwave frequencies suitable for the wood treatment is limited to from about 0.1 GHz to about 24 GHz. It is impossible at a frequency less than about 0.1 GHz to create sufficient energy in the wood to destroy the cell walls because, at the required power density, electric breakdown (punch-through) takes place and the wood is carbonized. At a frequency greater than about 24 GHz, the penetration depth of microwaves in moist wood may be less than about 10 to 15 mm. This generally will not permit sufficient distribution of energy (temperature) to provide the desired effects.

The desired power intensity will vary with the selected microwave frequency. At a frequency of about 24 GHz, it is sufficient for the microwave intensity to be about 10 W/cm$^2$. However, at a microwave frequency of about 0.1 GHz, up to 100 kW/cm$^2$, preferably up to 50 kW/cm$^2$, and more preferably up to 10 kW/cm$^2$ is required for rapid heating and destruction of the wood cells. Preferred ranges of microwave frequency (f) and power intensity (p) are from about f=0.4 GHz and p=6 kW/cm$^2$ to about f=10 GHz and p=0.24 kW/cm$^2$, more preferably from about f=1 GHz and p=2.4 kW/cm$^2$ to about f=6 GHz and p=0.4 kW/cm$^2$.

The duration of the microwave treatment within the defined frequency and power intensity ranges is in the range of from 0.05 to 600 seconds, preferably 0.1 to 600 seconds, and will generally be less than 250 seconds, preferably less than 100 seconds, more preferably from about 1 to about 20 seconds. The minimum duration of the microwave treatment to increase the permeability of the wood is determined by the power of the microwave generator(s) used. The maximum capacity generator used in the timber industry is generally 500 kW. Experiments have shown the highest excessive pressure in the wood for making the radial-longitudinal checks must be about 400 kPa, and from a practical point of view it is difficult to create conditions for increasing the wood permeability during a period of less than 0.05 seconds. A microwave wood treatment of greater than 600 seconds is unlikely to produce good quality wood for impregnation, but longer periods may be used with combinations of very low microwave frequency and power intensity. However, commercially such long periods will not usually be acceptable.

To achieve wood modification (for example improvements in permeability) in different zones in the wood advantageously microwave radiation of different frequencies is used. For example, if timber has a cross-section of 100×100 mm, microwave modification may be achieved using a frequency of 2.4 GHz. The wood may subsequently be modified to a depth of 20 mm in which the modification is restricted to the ray cells. If a frequency of 0.915 GHz is employed, modification in the central zone of the wood may be effected by modification or destruction of the ray cells and formation of a number of cavities in the radial-longitudinal planes.

Wood cells have a maximum absorption of microwave energy if the electric field strength vector E is oriented parallel to the length of the cell. Rays are generally aligned in the radial direction (perpendicular to the main wood tissues (tracheids, libriform) so that the ray cells will have a maximum microwave energy absorption when vector E is oriented in the radial direction. With the vector E orientation parallel to the rays and perpendicular to the main wood tissues, the ray cells will heat faster than the other tissues of the wood and absorb more energy which permits the destruction of the ray cells without the destruction of the main wood tissues. The present process may also enable a reduction in energy consumption.

The dielectric properties of wood are dependent upon the vector E orientation to the main wood tissue direction. The dielectric loss factor of moist wood when vector E is oriented parallel to the main wood tissues has a value about 1.6 to 2.2 times higher than when vector E is oriented perpendicular to the tissues. Furthermore, the microwave penetration depth decreases about 1.5 to 2 times when the orientation of vector E is changed from perpendicular to the main wood tissues to parallel to the tissues, and the absorption ability of wood increases correspondingly. Accordingly, the effects of applying the microwave energy to the wood can be controlled by moving the vector E orientation between the preferred perpendicular direction to the wood tissues and parallel to the wood tissues.

The use of microwave energy for increasing permeability is most efficient at elevated temperature, and advantageously the method of the invention is performed at a wood temperature of about 80 to about 110° C., preferably about 90 to about 100° C. The wood may be heated by any suitable means, for example by convection, contact or electroconductive methods. Advantageously the wood is heated by means of microwave energy, for example at a frequency range of about 0.1 to about 24 GHz with a power intensity of from about 0.1 to about 10 W/cm$^2$. The microwave preheating may be carried out over any suitable period, for example from about 20 to about 600 seconds.

In order to increase the effect of the selective influence of microwave energy on ray cell destruction or resin softening, it may be advantageous at wood temperatures above about 100° C. to use energy impulses with high energy density. This may help to avoid overheating the body of the wood.

During high intensity microwave treatment, the surface of timber may be overheated and carbonised. To alleviate this, it is desirable to cool the surface using gas or air flow, preferably at speeds of not less than 1 m/sec, more preferably not less than 2 m/sec. applying gas or air flow to the surface of the wood may also advantageously remove vapours, dust and moisture from the zone of irradiation and may also avoid moisture condensation in the microwave applicator.

For uniform modification, wood may be moved through the zone of microwave irradiation at a constant speed with irradiation with microwaves of particular frequencies. In some cases, it may be advantageous to provide wood having treated and untreated zones, or zones with varying degrees of treatment and, therefore, with varying permeability. To control wood modification, whether uniformly or non-uniformly, the intensity and frequency of microwave irradiation can be altered during a treatment as required to provide the desired effect. This will be readily determined by those skilled in the art.

According to another aspect of the invention there is provided a wood-based material formed by microwave treatment of an untreated wood having a moisture content (based on dry-weight) of at least 15%, the wood-based material having a multitude of cavities primarily in the radial-longitudinal planes thereof formed by the full or partial destruction of ray cells and by expanding destroyed rays to cavities during the microwave treatment of the untreated wood, and having permeability in radial and longitudinal directions which is at least 5 times that of the untreated wood, wherein the overall integrity of the untreated wood is substantially maintained in the wood-based material.

The wood-based material may be uniform in permeability having the multitude of cavities spaced evenly throughout the body of the material. However, in another embodiment, the wood-based material has regions which have a high density of the cavities alternating with regions which have a low density of the cavities or which do not include any of the cavities. More particularly, the alternating regions may alternate in the longitudinal, radial and/or tangential directions of the wood-based material. Furthermore, the alternating regions may be selectively formed in the wood-based material, or may be random. The particular arrangement of these regions will generally depend on the anticipated use of the final product.

The increase in permeability of the wood-based material compared with the untreated wood is quite marked. As such, the uptake of treatment solution by the wood-based material is also dramatically increased compared with the untreated wood. Generally, the wood-based material will have a treatment solution uptake of from about 120 to about 550 l/m$^3$. More particularly, the wood-based material will have a copper-chrome-arsenic solution uptake of from about 190 to about 520 l/m$^3$. Additionally, the wood-based material according to the invention preferably has a good uptake of treatment materials such as, for example, creosote. Preferably, after 30 minutes soaking in creosote, the wood-based material according to the invention has an uptake of from about 115 to about 220 kg/m$^3$.

The overall integrity of the untreated wood is substantially maintained in the wood-based material according to the invention. That is, as discussed above, there is no significant destruction of cells of the main wood tissue in the wood-based material. However, there will generally be a reduction in mechanical properties of the wood-based material compared with those of the untreated wood. In particular, it can be expected that the wood-based material will have decreased modulus of elasticity (MOE) and decreased modulus of rupture (MOR) compared with the untreated wood. These factors will be taken into consideration and discussed in further detail in the following examples.

The present invention is suitable for round wood, lumber, beams and other timber and blanks of different forms. The method of increasing wood permeability can be used before any drying of the wood. The method is suitable for any species of wood, but is especially suitable for hard drying species with a high volume of ray cells, such as English oak.

The present invention will now be further described by way of example only with reference to the accompanying drawings in which.

Figure 1:
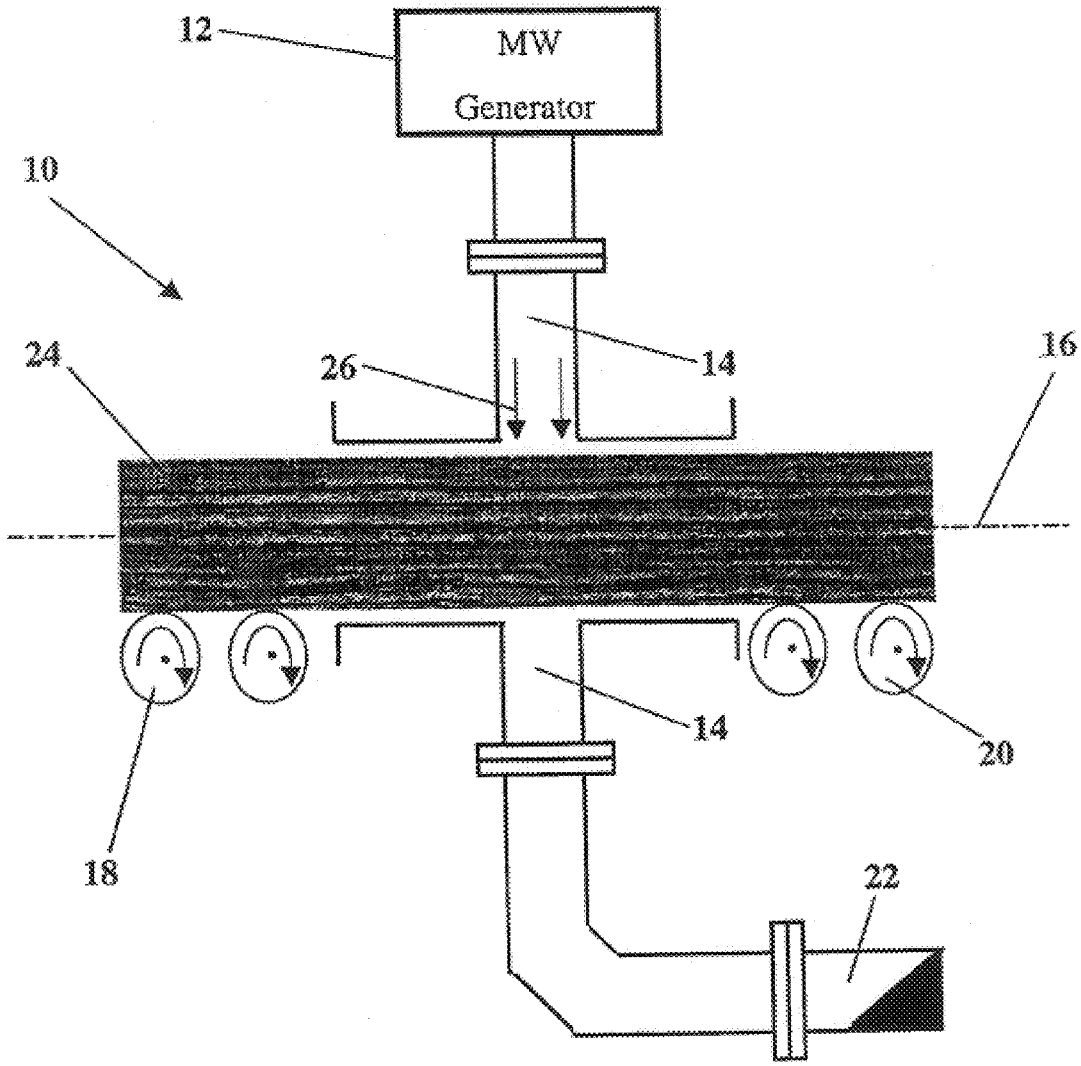
FIG. 1 is a schematic view of apparatus for performing the process of the invention.

Referring to FIG. 1, the apparatus 10 comprises a microwave generator 12 which directs microwave energy through a waveguide 14 perpendicular to a treatment path 16 defined by conveyor roller pairs 18 and 20 respectively upstream and downstream of the waveguide 14.

The waveguide 14 opens to an upper side of the treatment path 16, and is connected with a water load 22 which absorbs microwave energy which passes through a length 24 of timber.

The length 24 of timber is conveyed along the treatment path by the conveyor at a predetermined speed to give the desired treatment time opposite the waveguide 14.

The waveguide 14 directs microwaves perpendicularly to the length of timber as shown by arrows 26. Electric field strength vector E, therefore, is oriented perpendicularly to the length of timber (ie. to the main wood tissues). The orientation of vector E may be altered to parallel to the main wood tissues by electrical or mechanical means, as will be recognised by those skilled in the art.

Figure 2:
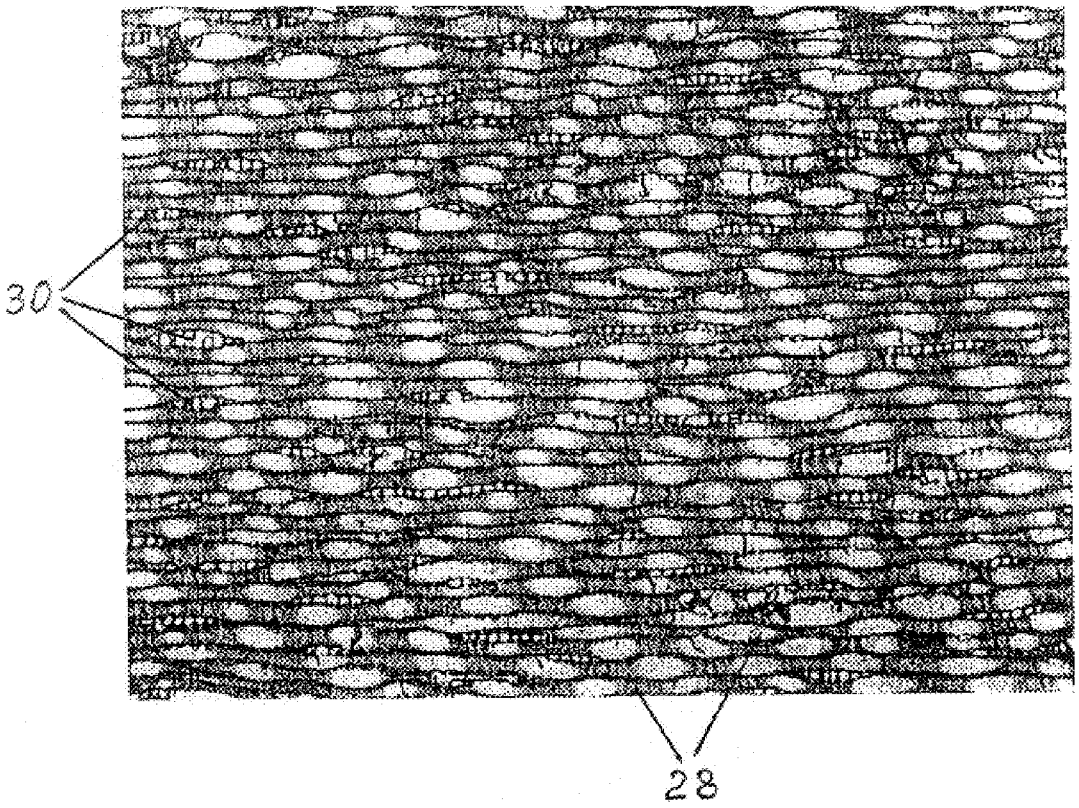
FIG. 2 is a photomicrograph at ×100 magnification illustrating the ray cells of radiata pine wood in tangential section.
Figure 3:
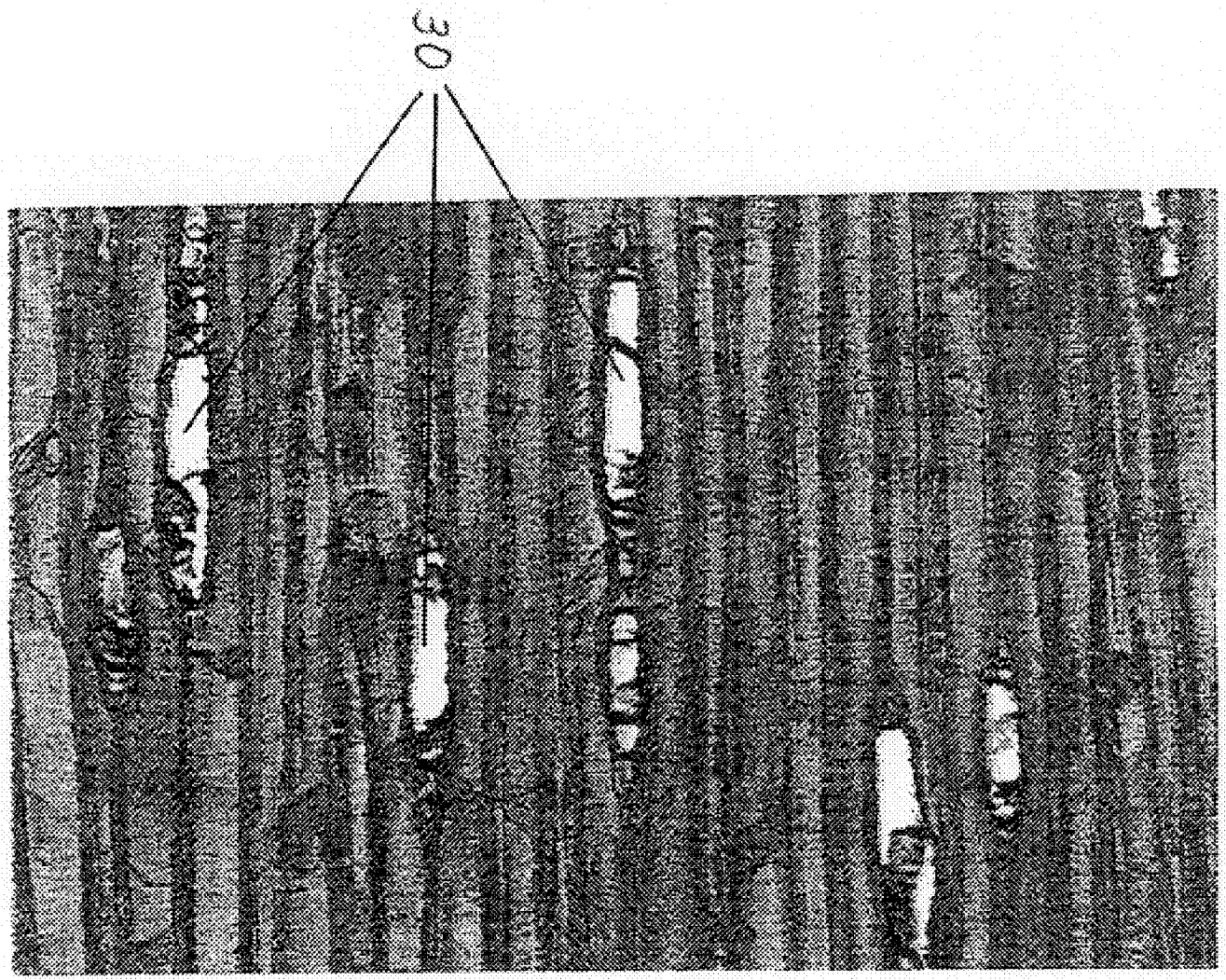
FIGS. 3 and 4 are photomicrographs at ×200 and 700 magnification, respectively, of radiata pine after microwave treatment in tangential section.
Figure 4:
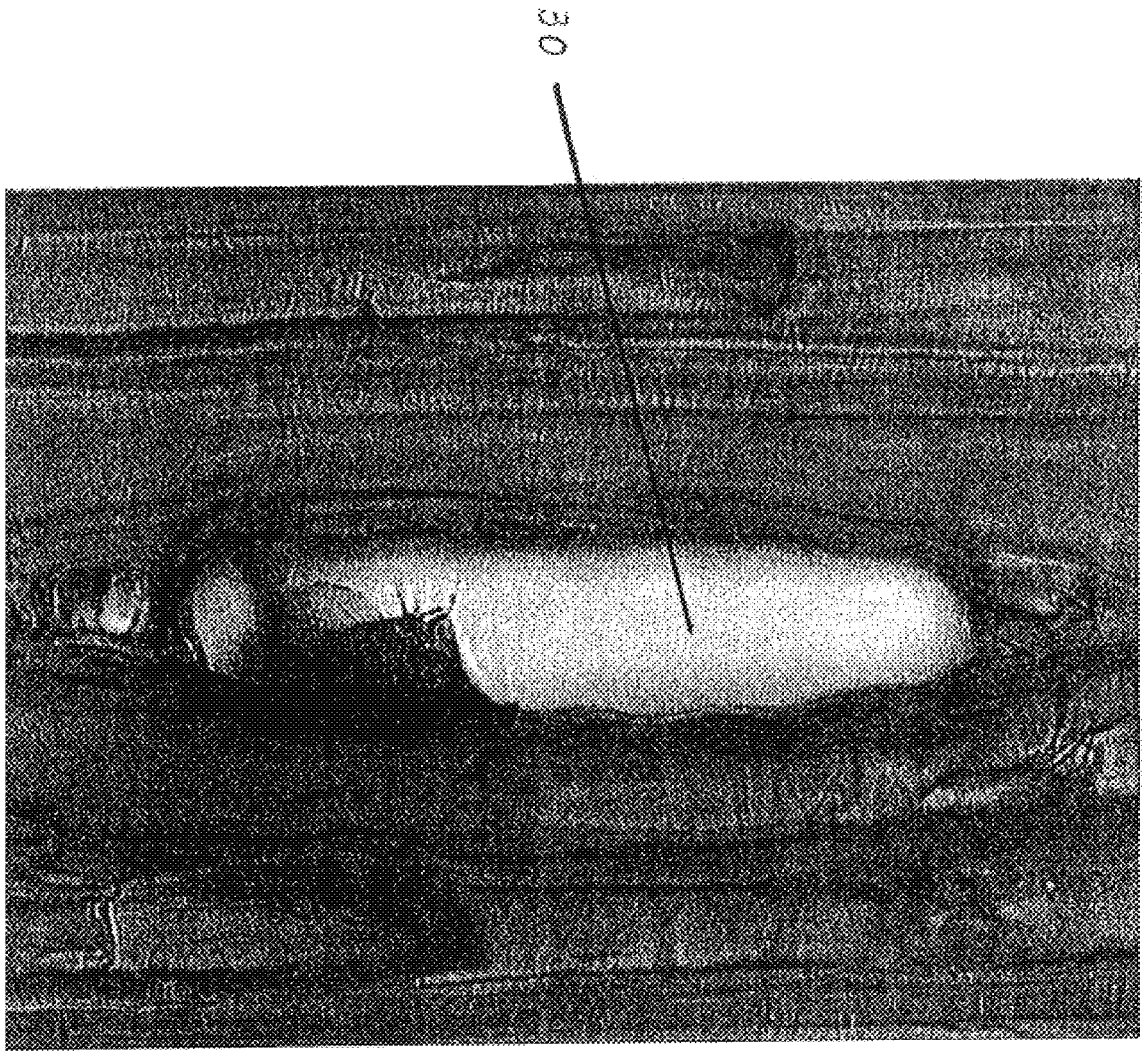

Referring now to FIGS. 2 to 4, the tangential-longitudinal sections of the photomicrographs clearly illustrate the grain of the wood and the individual fibres (tracheids) 28 extending from left to right in FIGS. 2 and 3 and from top to bottom in FIG. 4. Also clearly shown are numerous rays 30 extending approximately transversely to the section of the photomicrographs. FIG. 2 is a section of radiata pine taken prior to the microwave treatment, and the individual ray cells in each ray are clearly visible.

In FIGS. 3 and 4 the sections are of wood which has been subjected to microwave treatment in the apparatus 10 at a frequency of 2.45 GHz, a microwave power intensity of 250 W/cm$^2$ for a processing time of 7 seconds to destroy the individual ray cells and thereby increase the permeability of the wood. It is also clear from FIGS. 2 and 3 that the overall structure or integrity of the wood has been maintained.

Resinous channels which extend in the radial-longitudinal planes of the wood have a high microwave absorption ability relative to the surrounding wood. Therefore, on microwave treatment the resin softens and melts and, under vapour pressure, is forced to the surface of the wood leaving the channels vacant. At least a portion of the resin is also displaced through pores in adjacent wood cells. The vacant channels advantageously substantially increase the permeability of the wood and, therefore, the woods susceptibility to chemical penetration.

Figure 5:
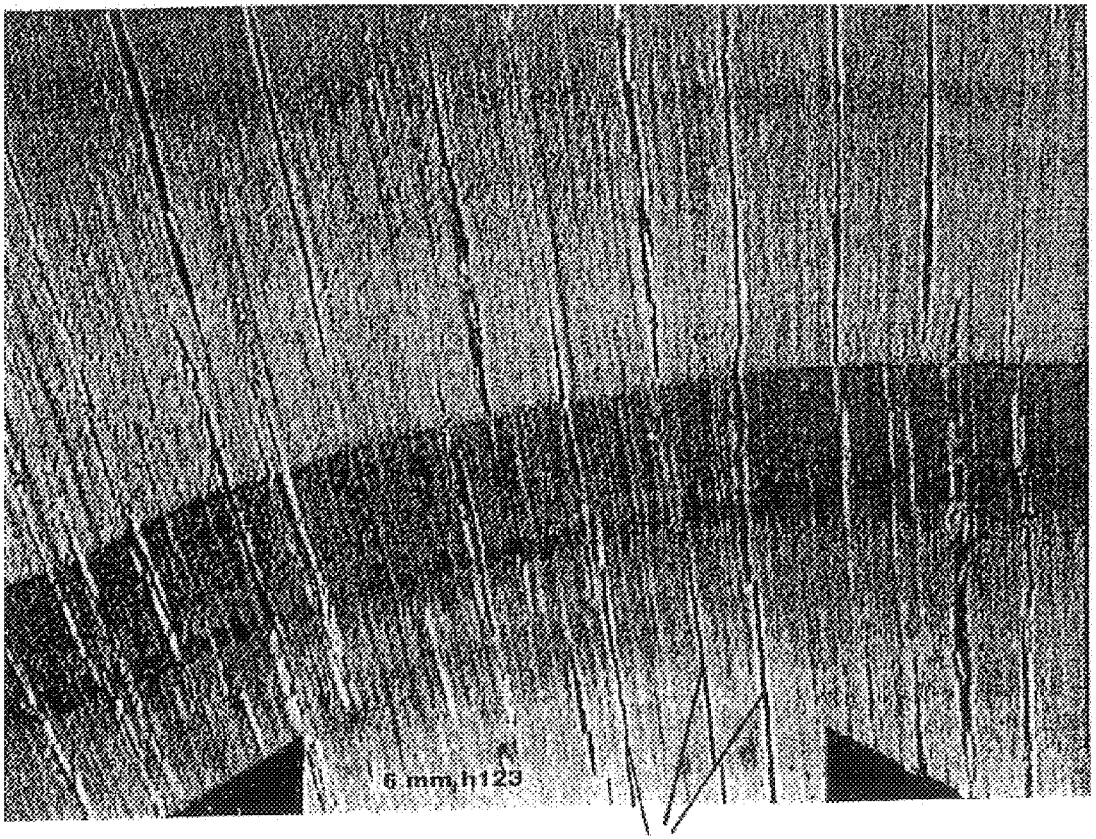
FIG. 5 is a photomicrograph at ×20 magnification of a transverse section of wood after microwave treatment.

In the transverse section of FIG. 5, it is possible to see checks 32 which are formed in radial-longitudinal planes of radiata pine wood after the wood has been subjected to microwave treatment in the apparatus 10 at a frequency of 2.4 GHZ and power intensity of 500 W/cm$^2$ for a duration of 8 seconds.

EXAMPLES

Example 1

The influence of microwave treatment on modulus of elasticity (MOE) and maximum bending strength (modulus of rupture—MOR) was investigated on samples of Radiata pine and Messmate wood. The following results were obtained:

Radiata Pine

Microwave treatment for increasing the permeability of Radiata pine at process parameters:

| | |
|---|---|
| MW frequency | −0.922 GHz |
| MW power | −18–36 kW |

Electric field strength vector E orientation—perpendicular to the grain

| | |
|---|---|
| Conveyor speed | 16 mm/s |
| Air temperature | 100–120° C. |

It was found that increasing microwave intensity leads to a reduction in Radiata pine MOE and MOR (%) as represented by the following table:

TABLE 1

| | | MOE | | MOR | |
|---|---|---|---|---|---|
| | Conv. speed (mm/s) | Tangetial dir. | Radial dir. | Tangetial dir. | Radial dir. |
| Control | | 100 | 100 | 100 | 100 |
| 18 kW | 16 | 74 | 96 | 77 | 94 |
| 27 | 16 | 62 | 93 | 65 | 90 |
| 36 | 16 | 51 | 92 | 54 | 87 |

Messmate

Microwave treatment for increasing the permeability of Messmate wood at process parameters:

| | |
|---|---|
| MW frequency | −0.922 GHz |
| MW power | −36–57 kW |

Electric field strength vector E orientation—perpendicular to the grain

| | |
|---|---|
| Conveyor speed | 12 mm/s |
| Air temperature | 100–120° C. |

It was found that increasing microwave intensity leads to a reduction in Messmate wood MOE and MOR (%) as represented by the following table:

TABLE 2

| | | MOE | | MOR |
|---|---|---|---|---|
| | Conv. speed (mm/s) | Tangetial dir. | Radial dir. | Tangetial & Radial dir. |
| Control | | 100 | 100 | 100 |
| 36 kW | 12 | 83 | 86 | 85 |
| 48 | 12 | 77 | 82 | 80 |
| 57 | 12 | — | — | 76 |

After microwave treatment the minimum reduction of strength properties (i.e. modulus of elasticity—MOE and modulus of rupture—MOR) were determined as follows (%):

TABLE 3

| | MOE | | MOR | |
|---|---|---|---|---|
| | Tangential dir. | Radial dir. | Tangetial dir. | Radial dir. |
| Radiata pine | 26 | 4 | 23 | 6 |
| Messmate | 17 | 12 | 15 | 15 |

Example 2

Permeability of Messmate wood prior to and after microwave treatment was also investigated and the following results obtained:

Messmate (moisture content 12%, oven dry density 740 kg/m$^3$)

Coefficient of air permeability (cm3 (air)/cm atm):

| | |
|---|---|
| after microwave conditioning | 291–1995 |
| control | 1.7 |
| Permeability increasing (times) | −171–1174 |

Example 3

Uptake of various wood types was investigated prior to and after microwave treatment and the following results obtained:

The permeability of wood is very variable therefore the quantity of CCA (copper-chrome-arsenic solution) uptake was used as an index of changing permeability after microwave treatment:

| | Control | After microwave conditioning |
|---|---|---|
| Uptake (1/m3) after pressure impregnation | | |
| Douglas fir heartwood | 60–90 | 375–426 |
| Radiata pine | 120–140 | 361–516 |
| Messmate | 18 | 192–255 |
| Yellow Stringibark posts | 46 | 340–400 |
| Uptake (kg/m3) after 30 minutes soaking in creosote | | |
| Messmate | 38 | 119–169 |
| Yellow Stringibark posts | 55 | 162–220 |

Example 4

Debarked green log radiata pine having a diameter of 120 mm is prepared for impregnation with preservative by subjecting it to microwave treatment in the apparatus 10. A microwave frequency of 0.915 GHz is selected for industrial purposes as this frequency ensures uniform distribution of temperature in the cross-section of the log.

The microwave power output of generator 12 is set at 50 kW to give an energy intensity of 420 W/cm$^2$, and the conveyor is set to give a processing time of 9 seconds, that is the time for each portion of the log to pass the microwave waveguide 14.

Example 5

Sapwood pine lumber with a cross-section of 5×5 cm is prepared for impregnation using the apparatus 10 of FIG. 1 at a frequency of 2.45 GHz, a microwave power output of 20 kW giving an energy intensity of 800 W/cm$^2$, and a processing time of 3 seconds.

In both of Examples 4 and 5, the permeability of the wood increased substantially without deteriorating the overall structure or integrity of the wood.

Using the microwave treatment of the present invention it may be possible to increase the permeability of wood samples up to and above 100 times the permeability of the sample prior to treatment. For example, a sample of pine timber treated at a frequency of 2.4 GHz, power intensity of about 10 W/cm$^2$ for 35 seconds increases in temperature to 95–100° C. After an additional 3 seconds treatment at a power intensity of about 500 W/cm$^2$, ray cells are destroyed and resin softened and removed to form open pores and thin radial checks and cavities primarily in the radial-longitudinal planes of the sample. The permeability of the wood sample in the radial direction is approximately 120 times that of the original untreated sample.

The density of the wood following treatment, corresponding to the density of the wood-based material was found to decrease depending on the particular microwave treatment schedule. For Radiata pine, the reduction was found to be in the order of up to 15% for Douglas fir, up to 9.4%, and for Messmate, up to 13.4%.

Thus, it is possible to form a novel wood product, "Torgvin", which has a multitude of cavities disposed in radial-longitudinal planes thereof. Furthermore, materials may be produced having treated and untreated zones by irradiating selected areas of sample, or by using intermittent or pulse irradiation. Materials in accordance with the invention, or produced by the method according to the invention, advantageously have very high permeability, increased flexibility, altered shrinkage and mechanical properties and lowered densities as compared with the natural wood.

Throughout this specification and the claims which follow, unless the context requires otherwise, the word "comprise", or variations such as "comprises" or "comprising", will be understood to imply the inclusion of a stated integer or group of integers but not the exclusion of any other integer or group of integers.

Those skilled in the art will appreciate that the invention described herein is susceptible to variations and modifications other than those specifically described. It is to be understood that the invention includes all such variations and modifications which fall within its spirit and scope. The invention also includes all of the steps, features, compositions and compounds referred to or indicated in this specification, individually or collectively, and any and all combinations of any two or more of said steps or features.

What is claimed is:

1. A method for increasing the permeability of wood which comprises subjecting wood with a moisture content (based on dry weight) of at least 15% to microwave radiation at a frequency (f) in the range of from about 0.1 to about 24 GHz with a power intensity (p) from about 10 W/cm$^2$ to about 100 kW/cm$^2$ for a duration of from about 0.05 to about 600 seconds to cause water in the wood to vaporise resulting in an internal pressure in the wood such that the permeability of the wood is increased by partial or complete destruction of ray cell tissue, softening and displacement of wood resin, formation of pathways in the radial direction of the wood and/or by creating, on the base of destroyed rays, cavities in the wood, said cavities being primarily in radial-longitudinal planes of the wood, and wherein the overall integrity of the wood is substantial maintained.

2. A method according to claim 1, wherein the electric field strength vector E of said microwave radiation during treatment of the wood is oriented perpendicularly to the wood grain and preferably parallel to the radial direction of the wood.

3. A method according to claim 1, wherein the electric field strength vector E of said microwave radiation during treatment of the wood is alternated between perpendicular and parallel orientations relative to the wood grain.

4. A method according to claim 1, wherein the wood is subjected to more than one microwave frequency and/or power intensity in a single treatment to provide treated wood having regions of differing or uniform permeability.

5. A method according to claim 1, wherein the microwave radiation is applied to the wood as impulses of predetermined duration and separated by set time intervals or as random impulses to provide treated wood having treated and untreated regions.

6. A method according to claim 1, wherein the wood, prior to irradiation, has a moisture content in the range of from about 15% to about 200% based on the dry weight of the wood.

7. A method according to claim 1, wherein the duration of the microwave irradiation is less than 250 seconds.

8. A method according to claim 7, wherein the duration of the microwave irradiation is from about 1 to about 20 seconds.

9. A method according to claim 1, wherein the irradiation of the wood is performed at a wood temperature of about 80 to about 110° C.

10. A method according to claim 9, wherein the wood is heated by convection, contact or electroconductive methods, or by means of microwave energy.

11. A method according to claim 1, wherein during the microwave irradiation the surface of the wood is subjected to gas or air flow at speeds of at least 1 m/sec.

* * * * *